United States Patent [19]

Jacklich

[11] 4,385,623

[45] May 31, 1983

[54] FLUE PIPE FOR FIREPLACE STOVE

[75] Inventor: John R. Jacklich, Palo Alto, Calif.

[73] Assignee: Simpson-DuraVent, Redwood City, Calif.

[21] Appl. No.: 189,253

[22] Filed: Sep. 22, 1980

[51] Int. Cl.[3] ..... F24C 15/30; F23J 11/00

[52] U.S. Cl. ..... 126/126; 126/307 R; 98/60

[58] Field of Search ..... 126/120–125, 126/126, 312, 301, 307 R, 127, 302; 110/119; 98/60, 67; 285/176

[56] References Cited

U.S. PATENT DOCUMENTS

| | | | |
|---|---|---|---|
| 234,921 | 11/1880 | Morgan et al. | 126/123 |
| 1,059,034 | 4/1913 | Clawson | 126/123 |
| 2,687,127 | 8/1954 | Leffler | 126/307 R |
| 2,791,213 | 5/1957 | Goulding et al. | 126/123 |
| 2,818,060 | 12/1957 | Field | 126/307 R |
| 2,976,796 | 3/1961 | Anthony et al. | 110/119 |
| 3,421,781 | 1/1969 | Spurk | 285/176 |
| 4,306,491 | 12/1981 | Reardon, Jr. | 126/126 |

FOREIGN PATENT DOCUMENTS

| | | | |
|---|---|---|---|
| 2707825 | 9/1977 | Fed. Rep. of Germany | 126/127 |
| 720206 | 12/1954 | United Kingdom | 285/176 |

*Primary Examiner*—James C. Yeung

*Attorney, Agent, or Firm*—John L. McGannon

[57] ABSTRACT

An improved flue pipe for placement in the flue associated with an interior fireplace having a stove mounted therein. The flue pipe extends through the flue and has a spark arrestor mounted on its upper end. The lower end of the flue pipe has means for connecting it to the combustion gas outlet of the stove mounted in the fireplace. The flue pipe has a number of interconnected sections and several of the sections are of shapes permitting the flue pipe to extend through the damper region of the flue notwithstanding the reduced cross-sectional area of the damper region.

1 Claim, 2 Drawing Figures

FLUE PIPE FOR FIREPLACE STOVE

Figure 1:
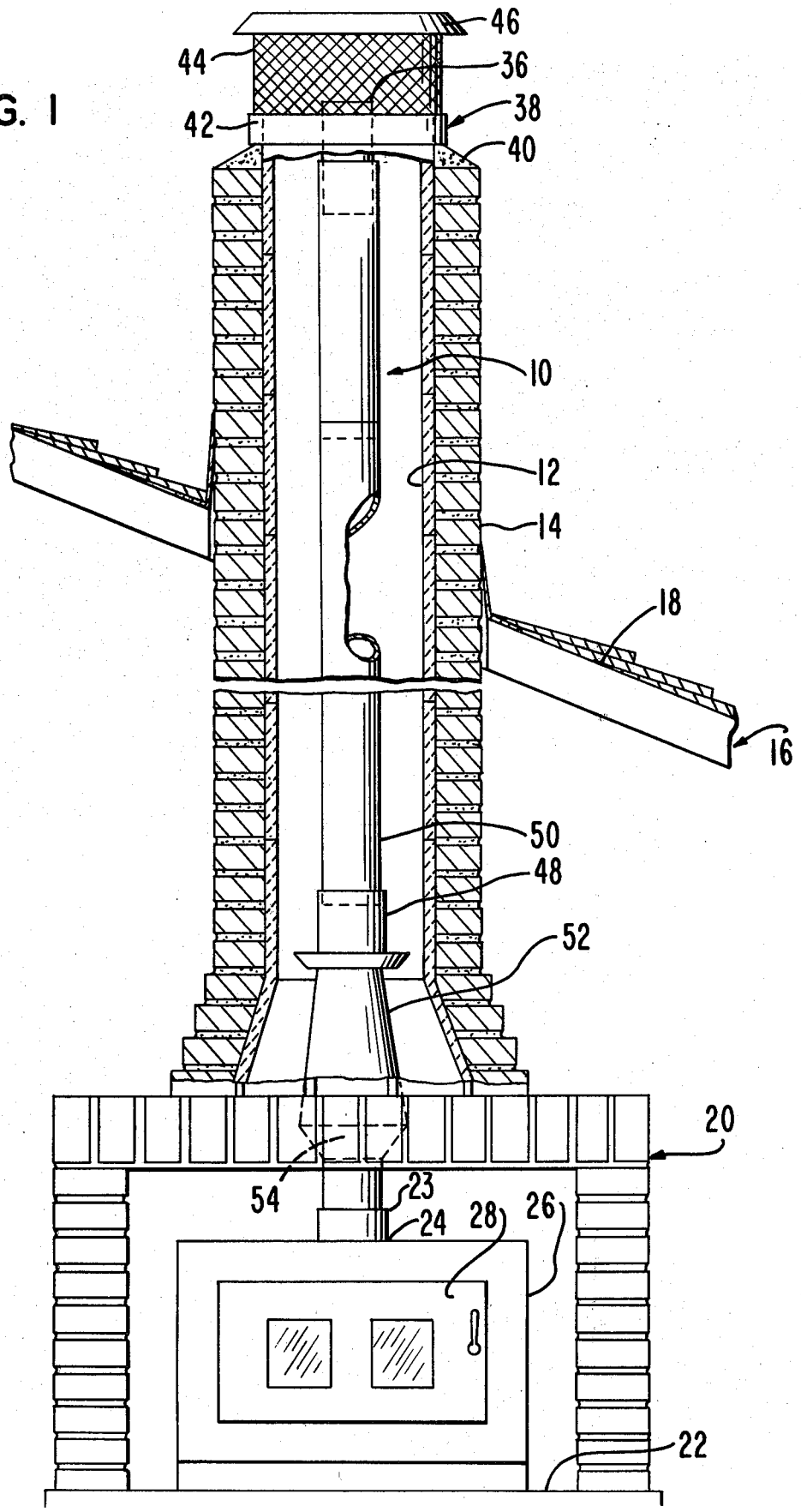

This invention relates to improvements in the use of a fuel-burning stove in a fireplace and, more particularly, to an improved flue pipe for such a stove.

BACKGROUND OF THE INVENTION

It is well known that the heat energy generated by the burning of wood in an interior fireplace is mainly lost because such heat energy rises in the flue associated with the fireplace and passes into the atmosphere. Only a small amount of the heat energy is radiated into the room in which the fireplace is located. While a fire in a fireplace gives the appearance of warming the room and the occupants of the room, it is clearly inefficient as a heat source.

To counter this loss of heat energy to the atmosphere, wood burning stoves have been used in or adjacent to fireplaces to burn wood or other fuel and to direct much of the generated heat energy laterally by radiation rather than vertically through a flue by convection. In this way, a stove in or adjacent to a fireplace can be a much more efficient heat source than can the fireplace used in a conventional manner.

A fire hazard arises when using a stove in a fireplace in that products of combustion rising from the stove through the flue adhere to the inner surface portions of the flue and these products are flammable at relatively low temperatures. This hazard presents an unsafe condition for the house or building containing the fireplace because sparks and flame can penetrate through cracks in the flue to adjacent wood and other flammable parts of the house or building and can cause fires. Because of this drawback, a need has arisen for improvements in the handling of combustion products emanating from a fuel-burning stove in a fireplace to assure a safer operation of the stove without sacrificing the efficient energy transfer characteristics of the stove itself.

SUMMARY OF THE INVENTION

The present invention satisfies the aforesaid need by providing an improved metallic flue pipe for a stove mounted in an interior fireplace wherein the flue pipe is adapted to extend from the stove through and to the upper end of the flue coupled with the fireplace. Thus, the products of combustion from the stove will pass upwardly through the flue pipe to the atmosphere and will not be able to contact and adhere to the inner surface of the flue. Thus, the flue pipe eliminates any possible fire hazard which might arise due to the passage of flammable combustion products from the stove to the atmosphere.

To this end, the flue pipe of the present invention is made of a suitable material, such as stainless steel or the like, which prevents any substantial adhering of combustion products on the inner surface portions thereof. Such material also assures that, even if there is some adhering of the products to the flue pipe, such products do not present a fire hazard because the products can be burned in the flue pipe while preventing the spread of fire to adjacent portions of the house or building in which the stove and fireplace are located.

The flue pipe is typically made in sections with most of the sections being generally cylindrical and the uppermost section being coupled to a spark arrestor at the top of the flue. Since the damper region of a flue usually has a reduced cross-sectional area, the sections of the flue pipe which are to extend through this region are flattened without substantially changing their cross-sectional area. Thus, the cross-sectional area of the flue is substantially uniform throughout its entire length.

The lower end of the flue pipe has means thereon for connecting it to the combustion gas outlet of the stove in the fireplace; thus, combustion gases generated in the stove can rise uninterruptedly through the flue pipe to the atmosphere notwithstanding the presence of a damper region of reduced cross-sectional area in the flue. The flattened shape of the pipe sections in the damper region presents no problem of exhausting the combustion gases from the stove because the uniform cross-section of the flue pipe throughout its length.

The primary object of the present invention is to provide an improved flue pipe for use with a fuel-burning stove in a fireplace wherein the flue pipe has means thereon for connecting it to the combustion gas outlet to the stove yet the flue pipe can extend throughout the entire length of the flue of the fireplace notwithstanding the presence of a restricted damper region immediately above the fireplace.

Other objects of this invention will become apparent as the following specification progresses, references being had to the accompanying drawings for an illustration of the invention.

IN THE DRAWINGS

Figure 2:
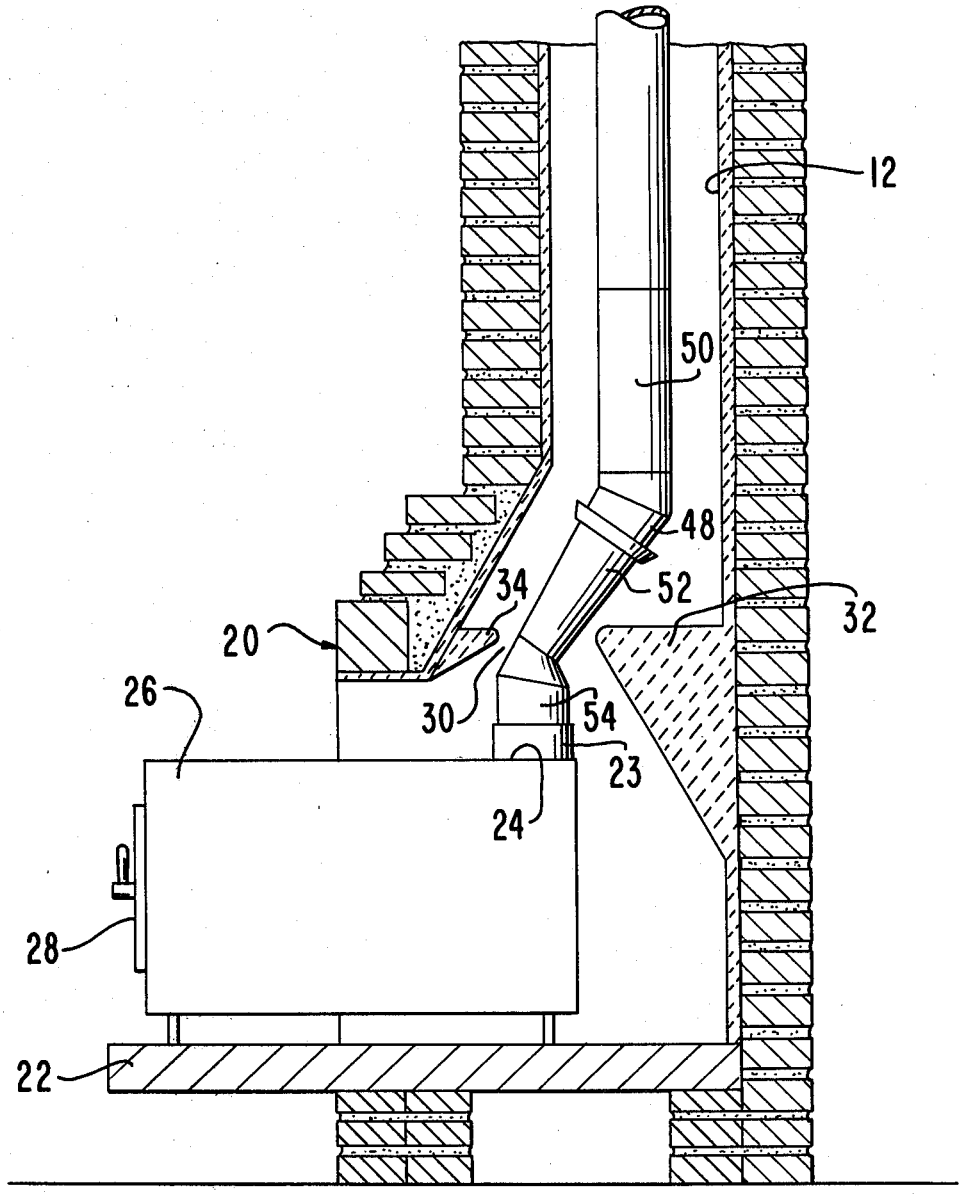

FIG. 1 is a front elevational view of a fireplace and its flue showing the improved flue pipe of the present invention coupled with a fuel-burning stove in the fireplace, parts being broken away and in section to illustrate details of construction; and FIG. 2 is a fragmentary, vertical section through the fireplace showing a side elevational view of the improved flue pipe and stove in the fireplace.

The flue pipe of the present invention is broadly denoted by the numeral 10 and is shown in FIGS. 1 and 2 as being mounted in the flue 12 of a conventional chimney 14 of a house or building 16 having a roof 18 and a fireplace 20 inside the house adjacent to a floor or base 22. The flue pipe has connecting means 23 at its lower end for coupling the flue pipe to the combustion gas outlet 24 of a fuel-burning stove 26 mounted in or adjacent to the fireplace and supported on floor 22. The stove will usually be wood-burning but it can also be of the gas-burning or oil-burning type, if desired.

Stove 26 can be conventional in construction. It has a door 28 at the front to permit access to its interior. Outlet 24 is near the rear of the stove and is generally near the damper region 30 of flue 12. Typically, this region is inclined by virtue of a pair of shoulders 32 and 34, shoulder 32 being vertically below the main portion of flue 12 and shoulder 34 being offset from the flue. A damper (not shown) is also used with the fireplace; however, with stove 26, such a damper is not needed. Instead, flue pipe 10 can have its own damper (not shown) near the lower end thereof in conjunction with the control of smoke and combustion gases from stove 26 through outlet 24.

Flue pipe 10 is typically made in sections and the sections are interconnected to form a continuous path from stove outlet 24 to the upper end 36 of the flue. End 36 projects into a spark arrestor 38 which is supported in any suitable manner on the upper end 40 of chimney 14. Arrestor 38 has a base 42, a sidewall formed of a wire grid 44, and a top cover 46.

There may be any number of pipe sections connected together to form flue pipe 10. The pipe sections are generally transversely circular except for the pipe sections in the vicinity of damper region 30. To this end, flue pipe 10 includes one or more tubular sections which are flattened to permit those sections to extend through damper region 30 which is of a reduced cross-sectional area with reference to the vertical part of flue 12. For purposes of illustration, a first, cylindrical pipe section 48 is connected to the lower end of a second, cylindrical pipe section 50. Sections 48 and 50 will generally have the same cross-sectional area and section 48 is angled to permit a change in direction of the flue pipe in the manner shown in FIG. 2. A third pipe section 52 extending through damper region 30 is cylindrical at one end to mate with section 48 and is progressively flattened as the opposite end is approached to permit it to extend between shoulders 32 and 34. The flattening of section 52 makes it longer in one dimension than in another dimension although the cross-sectional area of section 52 will remain substantially the same throughout its length. Finally, a fourth section 54 is shaped to connect with the flattened lower end of section 52 with the outlet 24 of stove 26.

To put flue pipe 10 in place, the flue pipe is inserted from the top of chimney 14 and moved downwardly through flue 12 with section 48 being at the lower end of the flue. Then, the flue pipe is anchored in place in the flue in any suitable manner. Arrestor 38 is secured to the upper end of the chimney and the upper end of flue 10 is rigidly secured to the arrestor.

Sections 52 and 54 are then coupled together and the upper end of section 52 is inserted through damper region 30 from below and coupled to the lower end of section 48. Stove 26 is then moved into an operative position into the fireplace and the lower end of section 54 is coupled by means 23 to outlet 24. The stove is then ready for use in burning wood.

As wood is burned in the stove, the products of combustion rise through flue pipe 10 and pass into the atmosphere through arrestor 38. Any combustion products which, in the absence of flue pipe 10, would normally accumulate or adhere on the inner surface of flue 12 cannot do so because of flue pipe 10. Thus, flue pipe 10 provides a means for safely delivering smoke and other combustion products from stove 26 to the atmosphere without requiring modifications to the chimney or the fireplace.

I claim:

1. A flue pipe assembly for use with a stove mounted in a fireplace, the fireplace coupled to a chimney having a flue with a narrowed damper region offset from a main flue region, the flue pipe assembly comprising:

a flue pipe having a length to permit the pipe to extend through the flue from the upper end thereof to the fireplace, said flue pipe including a first elongate portion of substantial uniform cross-sectional area in the main flue region and a second inclined portion extending downwardly from the first portion through the damper region, the second portion having a flattened section extending through the damper region, said flattened section having a rectangular cross-section, one dimension of the flattened section being greater than the other dimension thereof, the cross-sectional area of the flattened section being substantially the same as the cross-sectional area of the first portion of the flue pipe;

means at one end of the pipe for securing the pipe to the chimney at the upper end of said chimney;

connecting means at the lower end of the second portion for connecting the same to a combustion gas outlet of the stove; and a spark arrestor having means for securing the spark arrestor to said one end of the flue pipe, said spark arrestor adapted to be supported in a fixed position at the upper end of the flue.

* * * * *